US012660920B2

(12) United States Patent
Meese et al.

(10) Patent No.: US 12,660,920 B2
(45) Date of Patent: Jun. 23, 2026

(54) APPLIANCE AND SHELF POSITION TUNING SYSTEM

(71) Applicant: Haier US Appliance Solutions, Inc., Wilmington, DE (US)

(72) Inventors: David Meese, Evansville, IN (US); Nurein Ibrahim Ahmed, Louisville, KY (US); Mark Allen Stout, Elberfeld, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 18 days.

(21) Appl. No.: 18/797,726

(22) Filed: Aug. 8, 2024

(65) Prior Publication Data

US 2026/0041237 A1 Feb. 12, 2026

(51) Int. Cl.
*A47B 88/407* (2017.01)

(52) U.S. Cl.
CPC ..... *A47B 88/407* (2017.01); *A47B 2210/175* (2013.01)

(58) Field of Classification Search
CPC ..... A47B 88/407; A47B 2210/175; A47B 2088/952; A47B 88/956; A47B 88/994; A47B 88/427; A47B 2210/0054; A47B 88/40; F25D 25/025; F25D 23/067; F25D 23/021; F25D 25/005; F25D 25/04; F25D 25/022; F25D 25/00
See application file for complete search history.

(56) References Cited

U.S. PATENT DOCUMENTS

| | | | | |
|---|---|---|---|---|
| 4,810,045 | A * | 3/1989 | Lautenschlager | A47B 88/407 312/334.5 |
| 6,390,576 | B1 * | 5/2002 | Walburn | A47B 88/956 312/348.4 |
| 8,783,800 | B2 | 7/2014 | Benigni | |
| 8,939,526 | B1 * | 1/2015 | Chambers | A47B 77/18 312/348.4 |
| 9,752,817 | B2 | 9/2017 | Richards et al. | |
| 10,149,539 | B2 | 12/2018 | McGregor et al. | |
| 2008/0074019 | A1 * | 3/2008 | Park | A47B 88/956 312/348.4 |
| 2015/0342345 | A1 * | 12/2015 | McGregor | A47B 88/407 312/334.4 |
| 2016/0370105 | A1 * | 12/2016 | Park | F25D 25/025 |
| 2017/0176088 | A1 * | 6/2017 | Richards | F25D 23/028 |

(Continued)

*Primary Examiner* — Hiwot E Tefera
(74) *Attorney, Agent, or Firm* — Dority & Manning, P.A.

(57) ABSTRACT

An appliance includes a basket having a bottom wall and a plurality of sidewalls forming an interior compartment. The basket includes a first positioning wall and a second positioning wall extending from the bottom wall. The first positioning wall extends substantially co-directional to a first axis. The second positioning wall extends substantially co-directional to a second axis. A base assembly includes a base wall, a first perimeter wall, and a second perimeter wall. A first adjustment member extends from the first perimeter wall toward the first positioning wall co-directional to the second axis. A second adjustment member extends from the second perimeter wall toward the second positioning wall co-directional to the first axis. The base wall extends co-planar to the bottom wall. A third adjustment member extends from the base wall toward the bottom wall co-directional to a third axis.

16 Claims, 6 Drawing Sheets

(56) References Cited

U.S. PATENT DOCUMENTS

| | | | | |
|---|---|---|---|---|
| 2018/0224190 | A1 | 8/2018 | Yang | |
| 2019/0017739 | A1* | 1/2019 | Olvera | F25D 23/021 |
| 2019/0078835 | A1* | 3/2019 | Gatter | F25D 23/069 |
| 2019/0298059 | A1* | 10/2019 | Chen | A47B 88/994 |
| 2021/0247123 | A1 | 8/2021 | Dubina et al. | |
| 2021/0341216 | A1 | 11/2021 | Wei et al. | |
| 2024/0102724 | A1* | 3/2024 | Buchner | F25D 23/126 |

* cited by examiner

APPLIANCE AND SHELF POSITION TUNING SYSTEM

FIELD OF THE INVENTION

The present disclosure is related generally to appliances, and more particularly to positioning apparatuses for drawers and shelves for appliances.

BACKGROUND OF THE INVENTION

Appliances, such as refrigerators and oven appliances, generally include shelves and drawers. For instance, refrigeration appliances generally include shelves and drawers forming compartments at which various foodstuffs may be stored. Oven appliances may generally include an oven bake drawer typically positioned beneath a cooking chamber.

A problem with drawers and shelves at various appliances is binding or misalignment of the shelf, drawer, or rails relative to one another. Binding or misalignment may result from temperature exposure, temperature differentials between the drawers or shelves and the rails, or manufacturing differences between the drawers, shelves, rails, or cabinet of the appliance.

An appliance, drawers, and shelves addressing one or more of the aforementioned issues would be advantageous and beneficial.

BRIEF DESCRIPTION OF THE INVENTION

Aspects and advantages of the invention will be set forth in part in the following description, or may be apparent from the description, or may be learned through practice of the invention.

An aspect of the present disclosure is directed to an appliance. The appliance includes a cabinet forming an interior volume, a basket, and a base assembly. The basket includes a bottom wall and a plurality of sidewalls forming an interior compartment. The basket includes a first positioning wall and a second positioning wall extending from the bottom wall. The first positioning wall extends substantially co-directional to a first axis. The second positioning wall extends substantially co-directional to a second axis. A base assembly includes a base wall, a first perimeter wall, and a second perimeter wall, wherein a first adjustment member extends from the first perimeter wall toward the first positioning wall co-directional to the second axis. A second adjustment member extends from the second perimeter wall toward the second positioning wall co-directional to the first axis. The base wall extends co-planar to the bottom wall. A third adjustment member extends from the base wall toward the bottom wall co-directional to a third axis. The first axis, the second axis, and the third axis are mutually orthogonal to one another.

An aspect of the present disclosure is directed to an appliance including a cabinet forming an interior volume, a basket, and a base assembly. The basket includes a bottom wall and a plurality of sidewalls forming an interior compartment. The basket includes a first positioning wall and a second positioning wall extending from the bottom wall. The first positioning wall extends substantially co-directional to a first axis. The second positioning wall extends substantially co-directional to a second axis. The base assembly includes a base wall, a first perimeter wall, and a second perimeter wall, a slide assembly positioned along the first perimeter wall and extending co-directional to the first axis. The base assembly is positioned in the interior volume of the cabinet to selectively articulate the basket to and from the interior volume. A first adjustment member extends from the first perimeter wall toward the first positioning wall co-directional to the first axis. A second adjustment member extends from the second perimeter wall toward the second positioning wall co-directional to the second axis. The base wall extends co-planar to the bottom wall. A third adjustment member extends from the base wall toward the bottom wall co-directional to a third axis. The first axis, the second axis, and the third axis are mutually orthogonal to one another. The first adjustment member is selectively articulatable co-directional to the second axis. The second adjustment member is selectively articulatable co-directional to the first axis. The third adjustment member is selectively articulatable co-directional to the third axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
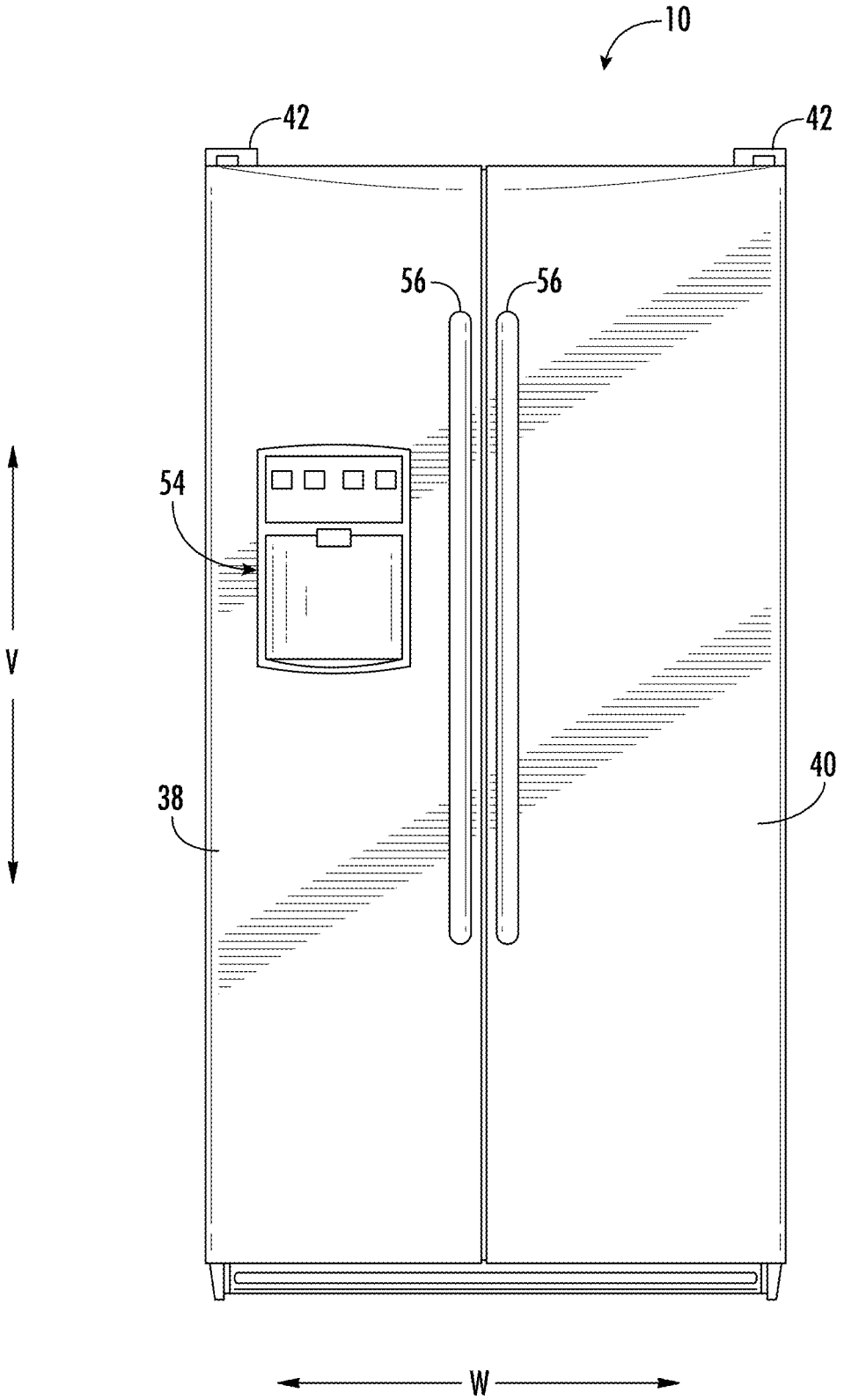
FIG. 1 provides a front view of a refrigerator appliance at which an embodiment of a basket assembly is positioned in accordance with aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Embodiments of an appliance and basket assembly configured for positioning tuning are provided that address one or more of the aforementioned issues.

Figure 2:
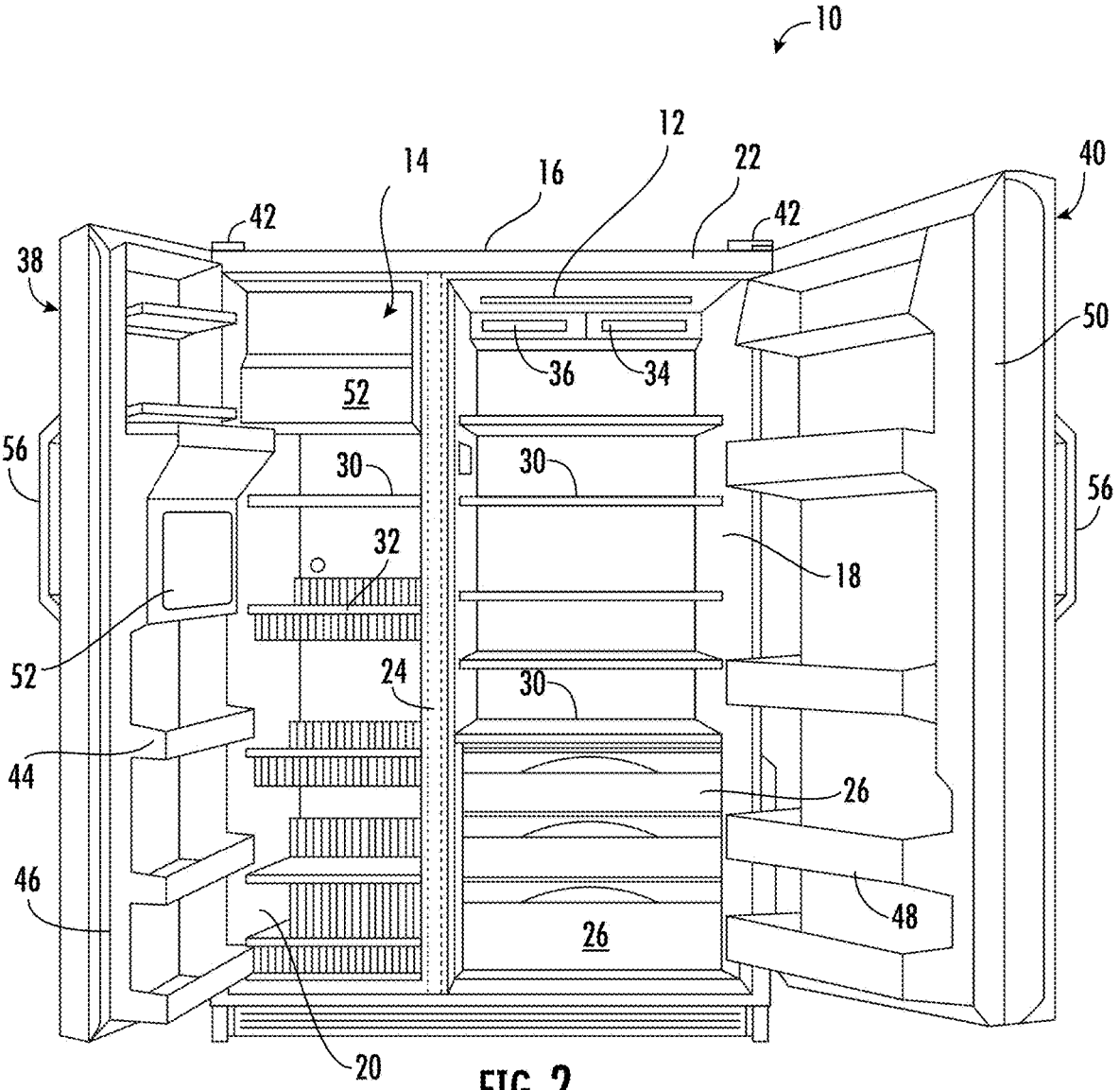
FIG. 2 provides a front open view of the refrigerator appliance of FIG. 1 at which an embodiment of a basket assembly is positioned in accordance with aspects of the present disclosure.

FIG. 1 provides a perspective view of a refrigerator appliance 10 at which a basket assembly according to an exemplary embodiment of the present subject matter may be positioned. FIG. 2 provides a perspective view of the refrigerator appliance 10 with doors 38, 40 open to view refrigeration and freezer compartments 12, 14 formed within a cabinet or outer case 16.

Referring to FIG. 2, refrigerator appliance 10 includes the refrigeration compartment 12 and the freezer compartment 14, with the compartments arranged side-by-side and contained within the outer case 16. Outer case 16 and inner liners 18 and 20 are generally molded from a suitable plastic or foam material. For instance, the outer case may form a molded plastic or foam outer case. Thus, refrigerator appliance 10 is generally referred to as a side-by-side style refrigerator appliance. In alternative exemplary embodiments, refrigerator appliance 10 may include a single liner and a mullion that spans between opposite sides of the single liner to divide it into the freezer compartment 14, such as a compartment configured for frozen foods, and the refrigeration compartment 12, such as a compartment configured for fresh foods. Outer case 16 is normally formed by folding a sheet of a suitable material, such as pre-painted steel, into an inverted U-shape to form top and side walls of outer case 16. A bottom wall of outer case 16 normally is formed separately and attached to the case side walls and to a bottom frame that provides support for refrigerator appliance 10. However, it should be appreciated that outer case 16 may be formed by other suitable manufacturing methods.

A breaker strip 22 extends between a case front flange and outer front edges of inner liners 18 and 20. Breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 may form a front face, and extend completely around inner peripheral edges of outer case 16 and vertically between inner liners 18 and 20.

Slide-out drawers 26 and shelves 30 are provided in refrigeration compartment 12 to support items being stored therein. In addition, a shelf 30, a basket 32, or both, are generally provided in freezer compartment 14. Drawers 26 and shelves 30 may include a basket assembly 200 (FIG. 3) including a basket and a base assembly such as further described herein. For instance, cabinet or outer case 16 may generally form one or more interior volumes, such as compartments 12, 14, at which the slide-out drawers 26 and shelves 30 are positioned.

Refrigerator appliance features are regulated with a controller 34 according to user preference via manipulation of a control interface 36 mounted in an upper region of refrigeration compartment 12 and coupled to controller 34. Input/output ("I/O") signals may be routed between controller 34 and various operational components of refrigerator appliance 10. The components of refrigerator appliance 10 may be in communication with controller 34 via one or more signal lines or shared communication busses.

Controller 34 can be any device that includes one or more processors and a memory. As an example, in some embodiments, controller 34 may be a single board computer (SBC). For example, controller 34 can be a single System-On-Chip (SOC). However, any form of controller 34 may also be used to perform the present subject matter. The processor(s) can be any suitable processing device, such as a microprocessor, microcontroller, integrated circuit, or other suitable processing devices or combinations thereof. The memory can include any suitable storage media, including, but not limited to, non-transitory computer-readable media, RAM, ROM, hard drives, flash drives, accessible databases, or other memory devices. The memory can store information accessible by processor(s), including instructions that can be executed by processor(s) to perform aspects of the present disclosure.

Referring to FIGS. 1-2, a freezer door 38 and a fresh food door 40 close access openings to freezer compartment 14 and refrigeration compartment 12. Freezer door and fresh food door 38 and 40 are each mounted by a top hinge 42 and a bottom hinge (not shown) to rotate about its outer vertical edge between an open position, as shown in FIG. 1, and a closed position. Freezer door 38 may include a plurality of storage shelves 44 and a sealing gasket 46, and fresh food door 40 also includes a plurality of storage shelves 48 and a sealing gasket 50.

Freezer compartment 14 may include an automatic ice maker 52 and a dispenser 54 (FIG. 1) provided in freezer door 38 such that ice and/or chilled water can be dispensed without opening freezer door 38, as is well known in the art. Freezer door and fresh food door 38 and 40 may be opened by handles 56.

Figure 3:
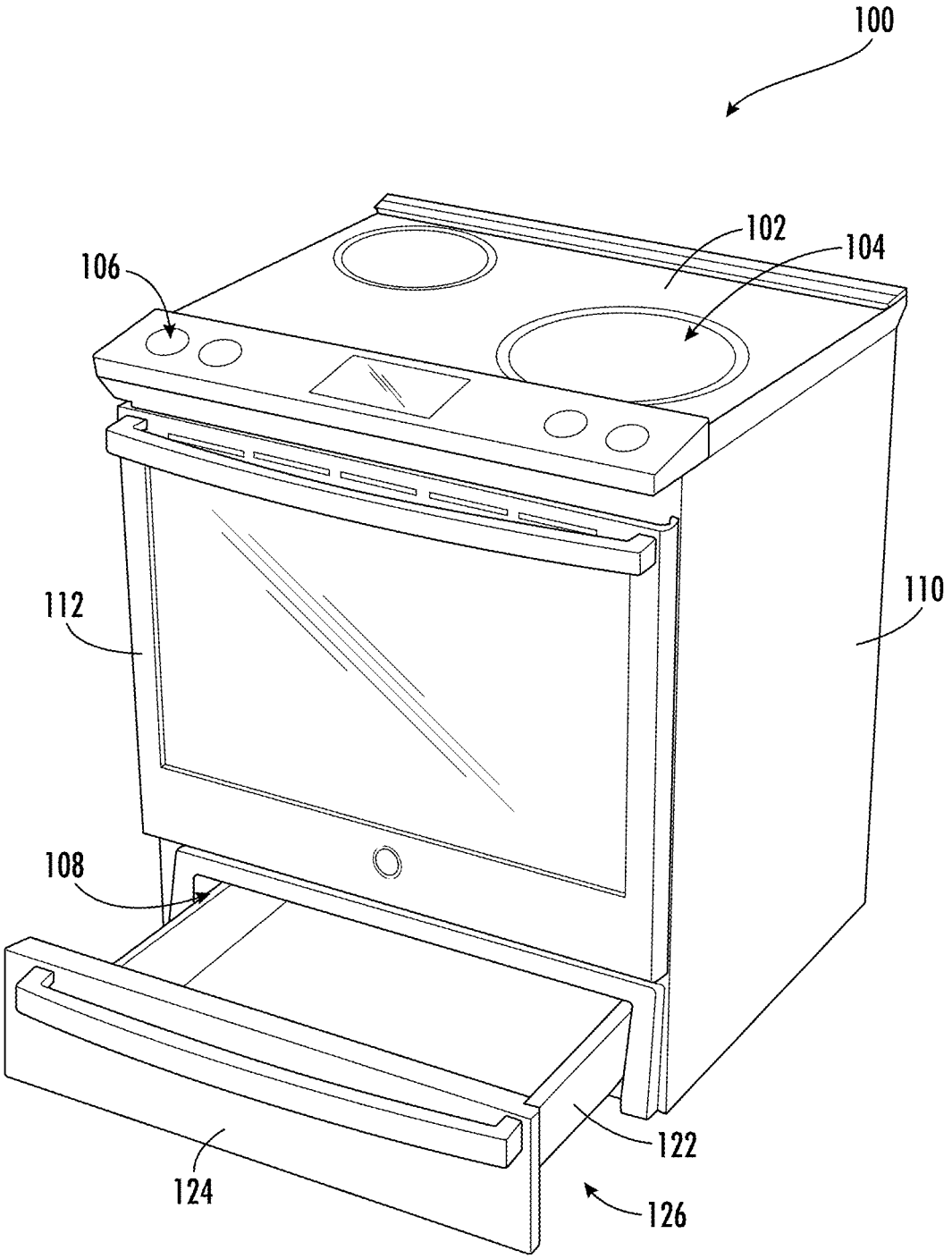
FIG. 3 provides a perspective view of an oven appliance at which an embodiment of a basket assembly is positioned in accordance with aspects of the present disclosure.
Figure 4:
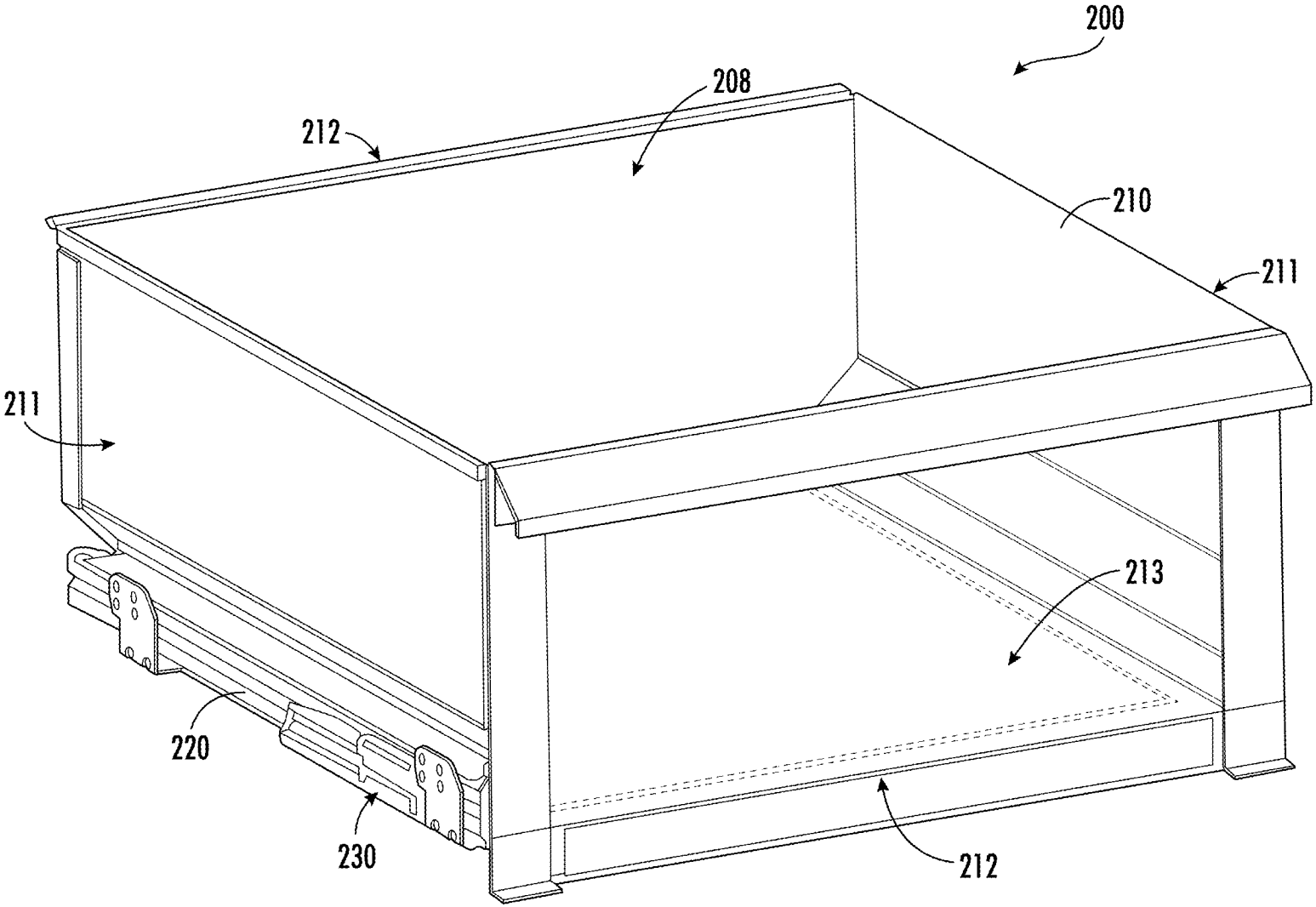
FIG. 4 provides a perspective view of an exemplary embodiment of a basket assembly in accordance with aspects of the present disclosure.

Referring briefly to FIG. 3, a perspective view of an embodiment of an oven appliance 100 at which a basket assembly according to an exemplary embodiment of the present subject matter may be positioned is provided. Appliance 100 includes a cabinet 110 forming one or more interior volumes. As generally understood, a cooktop surface 102 may include a heating element 104. Controls 106, such as dials, buttons, or other user interfaces, is configured to selectively command heating operations, such as may generally be understood for an oven and cooking appliance. A cooking chamber (not shown) is accessed by articulating an oven door 112. An oven bake drawer 126 is positioned below the cooking chamber. The drawer 126 includes sidewalls 122 and a front door 124 configured to slide into and out of an interior volume 108 forming an oven chamber.

Referring now to FIGS. 4, 5, 6A, and 6B, views of an embodiment of a basket assembly 200 including a shelf or drawer position tuning system are provided. Embodiments of the basket assembly 200 include a basket 210, such as a drawer 26, 126, or shelf 30 depicted and described regarding appliances 10, 100 in FIGS. 1-3. It should be appreciated that FIGS. 1-3 provide exemplary embodiments of refrigeration and oven appliances at which the basket assembly 200 is positionable, such as to facilitate position tuning and provide advantages and benefits further described herein. However, it should be appreciated that embodiments of the basket assembly 200 may be included at other embodiments and configurations of appliances may be included not further depicted or described above.

The basket assembly 200 includes a base assembly 220 positioned at an interior volume of the appliance, such as compartments 12, 14 or oven chamber 108 depicted and described regarding appliances 10, 100 in FIGS. 1-3. The basket 210 is selectively positioned onto and at the base assembly 220 to facilitate selective articulation of the basket 210 into and out of the interior volume.

A reference coordinate axis extends from a center point of the base assembly 220. The coordinate axis includes a mutually orthogonal first axis 201, second axis 202, and third axis 203. A transverse direction T extends co-directional to the first axis 201, a longitudinal direction L extends co-directional to the second axis 202, and a vertical direction V extends co-directional to the third axis 203. The transverse direction T may correspond substantially to a direction into and out of an interior volume of the appliance.

The basket 210 includes a bottom wall 213 and a plurality of sidewalls 211, 212 forming an interior compartment 208. The basket 210 includes a first positioning wall 214 and a second positioning wall 215 extending from the bottom wall 213. The first positioning wall 214 extends substantially co-directional to the first axis 201. The second positioning wall 215 extends substantially co-directional to the second axis 202. The first and second positioning walls 214, 215 extend from the bottom wall 213 along the vertical direction V toward the base assembly 220. In some embodiments, the first and second positioning walls 214, 215 may extend co-directional to a perimeter of the sidewalls 211, 212.

The base assembly 220 includes a base wall 223, a first perimeter wall 221, and a second perimeter wall 222. The base wall extends substantially co-planar to the bottom wall 213 of the basket 210. A slide assembly 230 is positioned along the first perimeter wall 221 and extending co-directional to the first axis 201, such as along the transverse direction T. The slide assembly 230 may include a track, roller, or rail 232 configured to receive the basket 210 and facilitate translation of the basket 210 into and out of the interior volume of the appliance (e.g., along the transverse direction T).

A first adjustment member 241 extends from the first perimeter wall 221 toward the first positioning wall 214. The first adjustment member 241 extends co-directional to the second axis 202, such as along the longitudinal direction L. The first adjustment member 241 is configured to contact the first positioning wall 214 and apply a force onto the first positioning wall 214 along the longitudinal direction L.

A second adjustment member 242 extends from the second perimeter wall 222 toward the second positioning wall 215. The second adjustment member 242 extends co-directional to the first axis 201, such as along the transverse direction T. The second adjustment member 242 is configured to contact the second positioning wall 215 and apply a force onto the second positioning wall 215 along the transverse direction T.

A third adjustment member 243 extends from the base wall 223 toward the bottom wall 213. The third adjustment member 243 extends co-directional to the third axis 203, such as along the vertical direction V. The third adjustment member 243 is configured to contact the bottom wall 213 and apply a force onto the bottom wall 213 along the vertical direction V. A plurality of third adjustment members 243 extends through the base wall 223 to provide a surface at which the bottom wall 213 of the basket 210 is positioned. For instance, the basket 210 may rest along the vertical direction V onto the base assembly 220 at the plurality of third adjustment members 243.

In various embodiments, the first adjustment member 241 is selectively articulatable co-directional to the second axis 202, such as along the longitudinal direction L. The second adjustment member 242 is selectively articulatable co-directional to the first axis 201, such as along the transverse direction T. The third adjustment member 243 is selectively articulatable co-directional to the third axis 203, such as along the vertical direction V.

The base assembly 220 may include a platform wall 224 extending co-directional to the first and second perimeter walls 221, 222. The base wall 223 is positioned at an upper end of the platform wall 224, such as to position the base wall 223 raised along the vertical direction V. A channel 226 is formed between the platform wall 224 and the first and second perimeter walls 221, 222. The first and second adjustment members 241, 242 extend through respective first and second perimeter walls 221, 222 into the channel 226. As such, the platform walls 224 may extend substantially co-directional to the perimeter walls 221, 222 to form the channel 226 therebetween. The basket 210 positioned on the base assembly 220 positions the first and second positioning walls 214, 215 extending from the bottom wall 213 into the channel 226.

In some embodiments, the first, second, and third adjustment members 241, 242, 243 include a threaded shank. The threaded shank may include a screw (e.g., a set screw), a bolt, a threaded rod, etc., selectively threadable through respective openings at respective perimeter walls 221, 222 and base wall 223. For instance, a user may selectively thread the adjustment members 241, 242, 243 to adjust an extension of the adjustment members 241, 242, 243 into the channel 226 and distance along respective longitudinal, transverse, and vertical directions along which the adjustment members extend. The adjustment members 241, 242, 243 apply a force to push the respective walls 221, 222, 223 to adjust a position of the basket 210 along respective longitudinal, transverse, and vertical directions.

In still some embodiments, the first, second, and third adjustment members 241, 242, 243 include a spring. The adjustment members 241, 242, 243 including the spring are configured substantially such as described regarding the threaded shank, such as to apply a force to push the respective walls 221, 222, 223 to adjust a position of the basket 210 along respective longitudinal, transverse, and vertical directions.

In various embodiments, the base assembly 220 includes at least three third adjustment members 243 to form a plane at which the bottom wall 213 of the basket 210 rests. Third adjustment members 243 may be evenly adjusted to raise or lower a vertical height of the basket 210. Additionally, or alternatively, one or two or fewer than three of the third adjustment members 243 may be articulated to adjust, balance, or level the bottom wall 213. For instance, a user may articulate one or more of the third adjustment members 243 to correct twist, warping, or non-planar attitude of the bottom wall 213.

In still various embodiments, the base assembly 220 includes at least one first adjustment member 241 positioned along the second axis 202. For instance, the base assembly 220 may include a single first adjustment member 241 positioned centrally along the second axis 202 to evenly apply force to the first positioning wall 214 proximate to the first adjustment member 241. The single first adjustment member 241 may substantially evenly push the basket 210 along the longitudinal direction L, such as may maintain the first positioning wall 214 substantially parallel to the first perimeter wall 221.

The base assembly 220 may include at least one second adjustment member 242 positioned along the first axis 201. For instance, the base assembly 220 may include a single second adjustment member 242 positioned centrally along the first axis 201 to evenly apply force to the second positioning wall 215 proximate to the second adjustment member 242. The single second adjustment member 242 may substantially evenly push the basket 210 along the transverse direction T, such as may maintain the second positioning wall 215 substantially parallel to the second perimeter wall 222.

Figure 5:
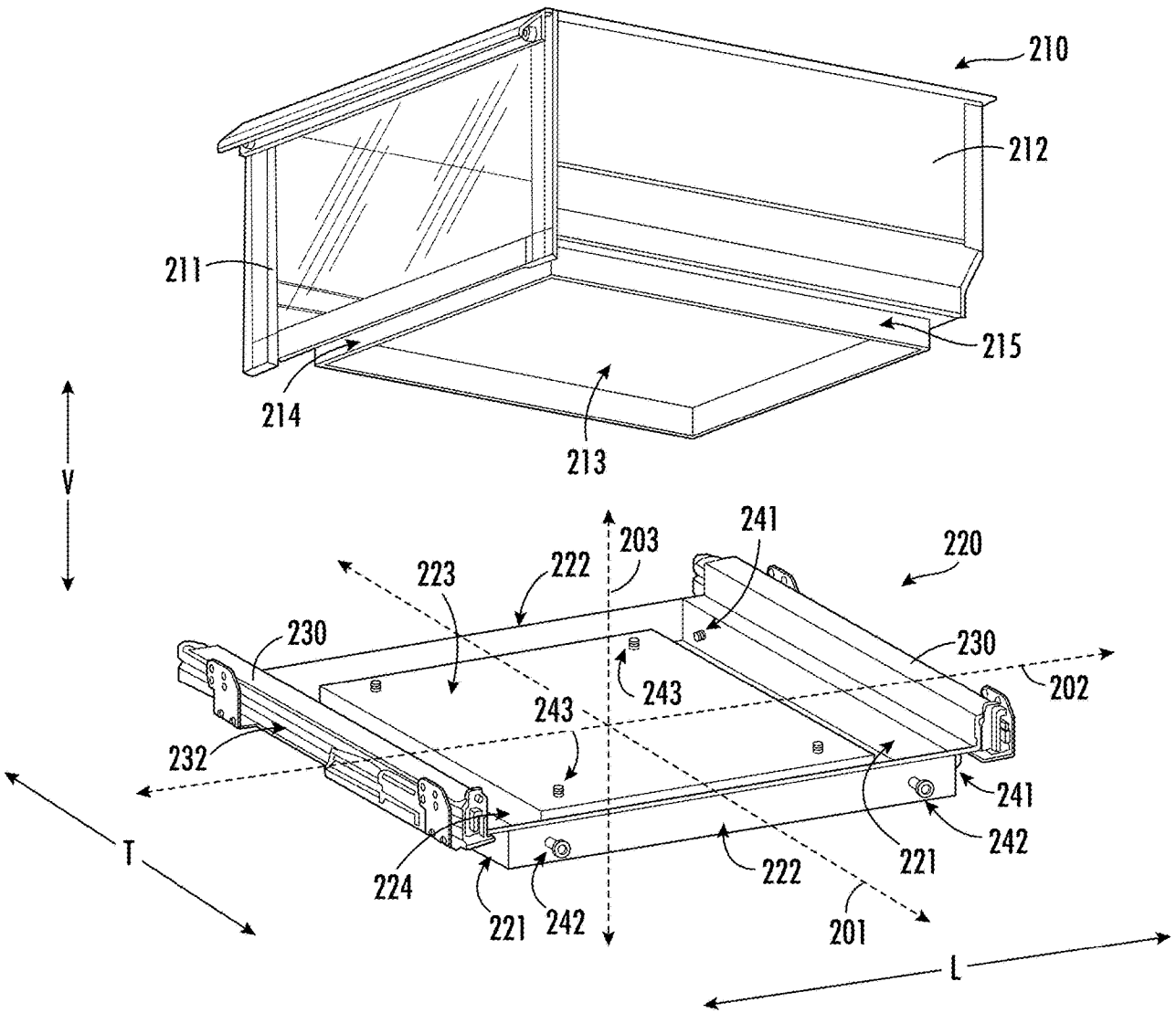
FIG. 5 provides an exploded view of the basket assembly of FIG. 4 in accordance with aspects of the present disclosure.
Figure 6A:
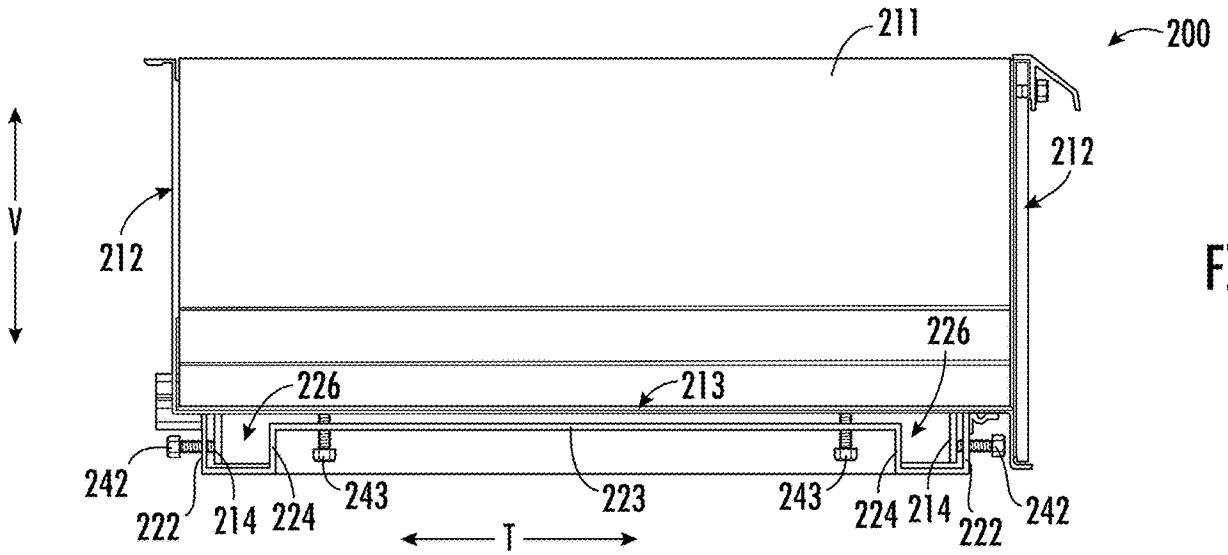
FIG. 6A provides a side cross sectional view of the basket assembly of FIG. 4 in accordance with aspects of the present disclosure.
Figure 6B:
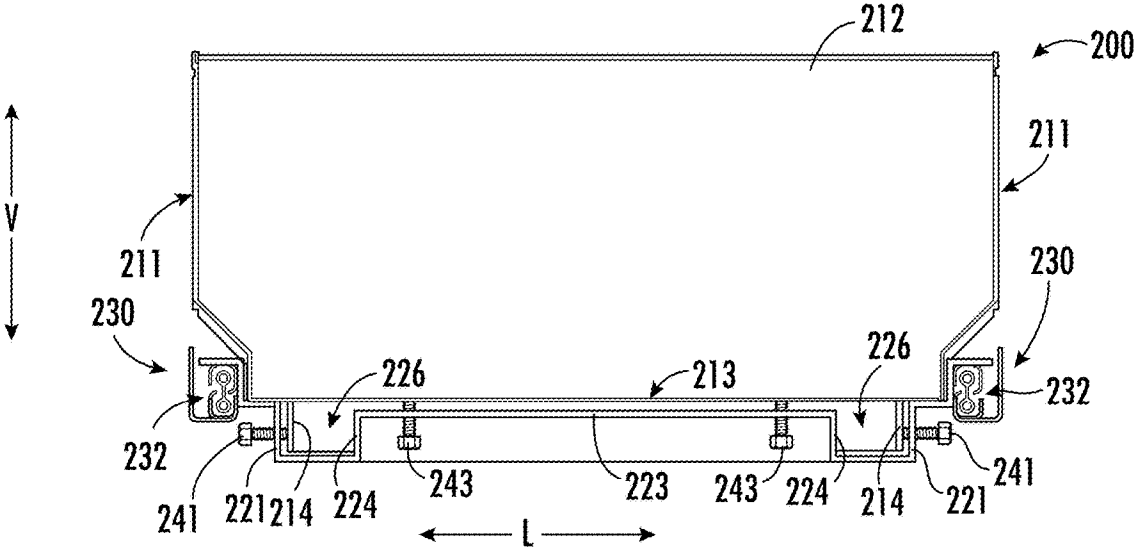
FIG. 6B provides a side cross sectional view of the basket assembly of FIG. 4 in accordance with aspects of the present disclosure.

In still yet some embodiments, the base assembly 220 includes at least two first adjustment members 241. At least one each of the first adjustment members 241 is positioned at opposing sides of the second axis 202, such as depicted at FIG. 5. For instance, a user may selectively articulate one of the two first adjustment members 241 to generate a rotation or twist relative to the third axis 203. The user may additionally articulate the other of the two first adjustment members 241 (i.e., the first adjustment member 241 positioned on other side of the second axis 202) oppositely of the first adjustment member 241 on the first side of the second axis 202, such as to further promote a rotation or twist of relative to the third axis 203.

The base assembly 220 may include at least two second adjustment members 242. At least one each of the second adjustment members 242 is positioned at opposing sides of the first axis 201, such as depicted at FIG. 5. For instance, a user may selectively articulate one of the two second adjustment members 242 to generate a rotation or twist relative to the third axis 203. The user may additionally articulate the other of the two second adjustment members 242 (i.e., the second adjustment member 242 positioned on other side of the first axis 201) oppositely of the second adjustment member 242 on the first side of the first axis 201, such as to further promote a rotation or twist of relative to the third axis 203.

Embodiments of the basket assembly 200 provided herein include arrangements of perimeter walls 221, 222, base wall 223, positioning walls 214, 215, and bottom wall 213 and adjustment members 241, 242, 243 forming the position tuning system for the basket 210 such as described herein. Embodiments provided herein facilitate fine adjustments to the position of the basket 210 relative to base assembly 220. Embodiments of the basket assembly 200 facilitate three-axis or four-axis tuning of the basket 210, such as may correct for warping, shifting, deflection, or bending of the basket 210 that may result from thermal loads, temperature differentials, or forces applied from contents within the interior compartment 208, across various portions of the basket 210 and/or base assembly 220.

Various embodiments of the basket assembly 200 may alleviate binding of the slide assembly associated with increased weight or thermal load at a slide, glide, rail, or roller. For instance, increased weights or thermal loads at the basket 210 may be adjusted and compensated for by articulating the adjustment members 241, 242, 243 such as described herein, such as may alleviate or remove binding.

Still various embodiments provided herein may facilitate opening or increase of manufacturing tolerances at the basket 210 and promote corrections to the basket 210 through articulating adjustment members 241, 242, 243 at the base assembly 220. For instance, embodiments of the basket assembly 200 may facilitate various geometries of baskets 210 to be included and mixed with the base assembly 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, the appliance comprising:

a cabinet forming an interior volume;

a basket comprising a bottom wall and a plurality of sidewalls forming an interior compartment, the basket comprising a first positioning wall and a second positioning wall extending from the bottom wall, wherein the first positioning wall extends substantially co-directional to a first axis, and wherein the second positioning wall extends substantially co-directional to a second axis; and a base assembly comprising a base wall, a first perimeter wall, a second perimeter wall, and a platform wall extending co-directional to the first and second perimeter walls, the base wall positioned at an upper end of the platform wall, wherein a channel is formed between the platform wall and the first and second perimeter walls, wherein a first adjustment member extends from the first perimeter wall toward the first positioning wall co-directional to the second axis, and wherein a second adjustment member extends from the second perimeter wall toward the second positioning wall co-directional to the first axis, and wherein the base wall extends co-directional to the bottom wall, wherein the first and second adjustment members extend through respective first and second perimeter walls into the channel, and wherein a third adjustment member extends from the base wall toward the bottom wall co-directional to a third axis, wherein the first axis, the second axis, and the third axis are mutually orthogonal to one another.

2. The appliance of claim 1, wherein the first adjustment member is selectively articulatable co-directional to the second axis, and wherein the second adjustment member is selectively articulatable co-directional to the first axis, and wherein the third adjustment member is selectively articulatable co-directional to the third axis.

3. The appliance of claim 1, the base assembly comprising:

a slide assembly positioned along the first perimeter wall and extending co-directional to the first axis.

4. The appliance of claim 1, the base assembly comprising at least three third adjustment members.

5. The appliance of claim 1, the base assembly comprising at least one first adjustment member positioned along the second axis.

6. The appliance of claim 5, the base assembly comprising at least one second adjustment member positioned along the first axis.

7. The appliance of claim 1, the base assembly comprising at least two first adjustment members, wherein at least one each of the first adjustment members is positioned at opposing sides of the second axis.

8. The appliance of claim 7, the base assembly comprising at least two second adjustment members, wherein at least one each of the second adjustment members is positioned at opposing sides of the first axis.

9. The appliance of claim 1, wherein the first, second, and third adjustment members comprises a spring.

10. The appliance of claim 1, wherein the first, second, and third adjustment members comprises a threaded shank.

11. The appliance of claim 1, wherein the first and second positioning walls extend from the bottom wall into the channel.

12. The appliance of claim 1, wherein the base assembly is positioned in the interior volume of the cabinet, and wherein the basket is positioned onto the base assembly.

13. The appliance of claim 1, wherein the appliance is a refrigeration appliance.

14. The appliance of claim 1, wherein the appliance is an oven appliance.

15. An appliance, the appliance comprising:

a cabinet forming an interior volume;

a basket comprising a bottom wall and a plurality of sidewalls forming an interior compartment, the basket comprising a first positioning wall and a second positioning wall extending from the bottom wall, wherein the first positioning wall extends substantially co-directional to a first axis, and wherein the second positioning wall extends substantially co-directional to a second axis; and a base assembly comprising a base wall, a first perimeter wall, a second perimeter wall, and a platform wall extending co-directional to the first and second perimeter walls, the base wall positioned at an upper end of the platform wall, wherein a slide assembly is positioned along the first perimeter wall and extending co-directional to the first axis, and wherein a channel is formed between the platform wall and the first and second perimeter walls, wherein the base assembly is positioned in the interior volume of the cabinet to selectively articulate the basket to and from the interior volume, wherein a first adjustment member extends from the first perimeter wall toward the first positioning wall co-directional to the second axis, and wherein a second adjustment member extends from the second perimeter wall toward the second positioning wall co-directional to the first axis, and wherein the base wall extends co-directional to the bottom wall, wherein a third adjustment member extends from the base wall toward the bottom wall co-directional to a third axis, wherein the first axis, the second axis, and the third axis are mutually orthogonal to one another, and wherein the first adjustment member is selectively articulatable co-directional to the second axis, and wherein the second adjustment member is selectively articulatable co-directional to the first axis, and wherein the third adjustment member is selectively articulatable co-directional to the third axis, and wherein the first and second adjustment members extend through respective first and second perimeter walls into the channel.

16. The appliance of claim 15, wherein the first and second positioning walls extend from the bottom wall into the channel.

* * * * *